US012523103B2

(12) United States Patent
Fourie et al.

(10) Patent No.: US 12,523,103 B2
(45) Date of Patent: Jan. 13, 2026

(54) MICROTUNNELING APPARATUS

(71) Applicant: OptionX Holdings Pty Ltd, Burleigh Waters (AU)

(72) Inventors: Albert Fourie, Burleigh Waters (AU); Allen Henley, Burleigh Waters (AU); Stuart Ronald Harrison, Burleigh Waters (AU); Gregory Alan Geldard, Mount Lofty (AU)

(73) Assignee: OptionX Holdings Pty Ltd, Burleigh Waters (AU)

( * ) Notice: Subject to any disclaimer, the term of this patent is extended or adjusted under 35 U.S.C. 154(b) by 0 days.

(21) Appl. No.: 18/852,591

(22) PCT Filed: Mar. 31, 2023

(86) PCT No.: PCT/AU2023/050253
§ 371 (c)(1),
(2) Date: Sep. 30, 2024

(87) PCT Pub. No.: WO2023/183989
PCT Pub. Date: Oct. 5, 2023

(65) Prior Publication Data

US 2025/0215750 A1 Jul. 3, 2025

(30) Foreign Application Priority Data

Mar. 31, 2022 (AU) ..... 2022900836

(51) Int. Cl.
*E21B 17/046* (2006.01)
*E21B 7/04* (2006.01)
*E21B 7/28* (2006.01)

(52) U.S. Cl.
CPC ..... *E21B 17/046* (2013.01); *E21B 7/046* (2013.01); *E21B 7/28* (2013.01)

(58) Field of Classification Search
CPC ..... E21B 7/046; E21B 17/04; E21B 17/046; E21B 17/18; E21B 17/28; E21B 10/26; E21B 10/28
See application file for complete search history.

(56) References Cited

U.S. PATENT DOCUMENTS 5,628,585 A * 5/1997 Parish, II ..... E21B 10/28 405/184
7,070,359 B2 * 7/2006 Richardson ..... F16L 1/036 405/184.5

(Continued)

FOREIGN PATENT DOCUMENTS

CN 113216851 A * 8/2021 ..... E21B 10/28
CN 118958875 A * 11/2024 ..... E21B 21/01

(Continued)

OTHER PUBLICATIONS

International Search Report and Written Opinion for Application No. PCT/AU2023/050253 dated Jun. 7, 2023 (4 pages).

(Continued)

*Primary Examiner* — Jennifer H Gay
(74) *Attorney, Agent, or Firm* — Michael Best & Friedrich LLP

(57) ABSTRACT

This invention relates to a reamer assembly (6) for enlarging a substantially horizontal pilot hole (14) in the ground to produce a bore hole (18), including a cutter (21) which is rotatable about an axis X-X. A gear box (20) is positioned on a first side of the cutter (21) for interacting with a drive shaft (33) which is rotated about the axis X-X by a drive apparatus (2) outside the pilot bore hole (14) and a body (15) positioned on a second side of the cutter (21) for transferring thrust from a thrust apparatus (4) outside of the enlarged bore hole (18) to the cutter (21).

17 Claims, 11 Drawing Sheets

(56) References Cited

U.S. PATENT DOCUMENTS

| | | | | |
|---|---|---|---|---|
| 7,152,702 | B1 * | 12/2006 | Bhome | E21B 10/345 175/413 |
| 7,845,432 | B2 * | 12/2010 | Salins | E21B 17/18 175/215 |
| 8,256,536 | B2 * | 9/2012 | Harrison | E21B 7/20 175/344 |
| 8,839,885 | B2 * | 9/2014 | Shuman, V | E21B 7/062 175/320 |
| 9,506,344 | B2 * | 11/2016 | Harrison | E21B 7/067 |
| 10,180,031 | B2 * | 1/2019 | Engle | E21B 7/046 |
| 10,465,460 | B2 * | 11/2019 | Barbera | E21B 21/16 |
| 10,526,846 | B2 * | 1/2020 | Barbera | E21B 7/20 |
| 10,900,286 | B2 * | 1/2021 | Engle | E21B 7/20 |
| 2004/0108139 | A1 * | 6/2004 | Davies | E21D 9/093 299/56 |
| 2004/0188142 | A1 * | 9/2004 | Self | E21B 7/06 175/406 |
| 2005/0257959 | A1 * | 11/2005 | Richardson | F16L 1/036 175/22 |
| 2009/0152012 | A1 * | 6/2009 | Salins | E21B 21/12 175/339 |
| 2010/0206635 | A1 * | 8/2010 | Harrison | E21D 9/093 175/344 |
| 2010/0206636 | A1 * | 8/2010 | Harrison | E21D 9/093 175/344 |
| 2011/0266062 | A1 * | 11/2011 | Shuman, V | E21B 21/12 175/173 |
| 2013/0008718 | A1 * | 1/2013 | Nguyen | E21B 21/12 175/122 |
| 2014/0151123 | A1 * | 6/2014 | Spoelstra | E21B 7/062 175/45 |
| 2015/0330148 | A1 * | 11/2015 | Utter | E21B 3/00 175/325.1 |
| 2016/0160566 | A1 * | 6/2016 | Engle | E21B 7/28 175/62 |
| 2018/0371841 | A1 * | 12/2018 | Barbera | E21B 7/20 |
| 2019/0093430 | A1 * | 3/2019 | Engle | E21B 7/20 |
| 2020/0325735 | A1 * | 10/2020 | Steiner | E21B 17/18 |
| 2025/0188800 | A1 * | 6/2025 | Harrison | E21B 4/00 |
| 2025/0188805 | A1 * | 6/2025 | Zur Linde | E21B 47/00 |
| 2025/0215750 | A1 * | 7/2025 | Fourie | E21B 7/046 |
| 2025/0215753 | A1 * | 7/2025 | Fourie | E21B 10/25 |

FOREIGN PATENT DOCUMENTS

| | | | | |
|---|---|---|---|---|
| CN | 119021707 | A * | 11/2024 | E21B 7/28 |
| DE | 10132753 | A1 | 3/2002 | |
| WO | 2014078660 | A1 | 5/2014 | |
| WO | 2015134689 | A1 | 9/2015 | |

OTHER PUBLICATIONS

International Preliminary Report on Patentability for Application No. PCT/AU2023/050255 dated Jul. 5, 2024 (7 pages).

* cited by examiner

BACKREAM THRUST APPARATUS

MICROTUNNELING APPARATUS

TECHNICAL FIELD

This invention relates to microtunneling apparatus for producing a substantially horizontal bore hole. The invention also relates to a reamer and to a microtunneling apparatus including a reamer and a drill string. The term microtunneling as used throughout this specification is a reference to drilling or boring a non-vertical hole, generally with a diameter of no greater than 1500 mm, where the operator is not required to enter the hole. It will be convenient to hereinafter describe the invention within this reference.

BACKGROUND OF INVENTION

The provision of services such as as telecommunications, gas, water supply, stormwater, sewerage, data, and electricity might traditionally involve excavating a trench, laying the services and backfilling the trench. This might have been convenient where the trench is relatively shallow and where there is no existing infrastructure on, for example, a "green fields" site. However as the depth of the trench increases, it can be difficult to provide machinery at a cost-effective rate to trench to the required depth. Furthermore, if there is other existing infrastructure that would be adversely impacted by an open trench, such as disruption or damage to major roadways or existing services, other methods of creating a conduit must be considered.

One other such method is microtunneling which will generally involve drilling apparatus having a drill head located at the end of a drill string that is rotated to drill a hole through the ground to produce the micro tunnel. The drill string is formed from a number of segments which each include a solid drill rod that transfers torque from a drive apparatus on the surface, or at the bottom of a vertical pit, to the drill head underground. The drill string can also include a supply conduit to accommodate supply fluid lines supplying pressurised fluid to the cutting head. The drill string can also include a spoil removal conduit through which the swarf and fluid adjacent the rear of the drill head, can move back to the drive apparatus.

It ought to be appreciated that the energy required to produce the micro tunnel is in part a function of the amount of spoil to be removed, so that the larger the tunnel the greater the energy required. While drilling is an option, it can be difficult to accurately direct a drill head. Deviations from a preferred line can result in spoil being removed unnecessarily. One method for minimising the unnecessary removal of spoil, is to drill a pilot hole and enlarge the pilot hole with a reamer assembly. The pilot hole can be relatively small, and so long as the pilot hole has been directed generally within section of spoil to be removed by the reamer, reaming will remove the spoil relatively efficiently.

A reamer assembly will generally utilise the drill rod in the drill string to rotate the reamer's cutting head, while the drill string is under tension as it draws the reamer assembly back through the pilot hole. The torque supplied by the drill rod to the reamer cutting head will be the same as that supplied to the drill head, however the working face that the reamer cutting head engages will be a greater diameter than the pilot hole. The spoil will generally be removed also through the pilot hole, often using a vacuum arrangement, which is not ideal as the cutting head will be producing spoil at a diameter greater than the pilot hole. This results in the cutting head churning spoil rather than cutting into the working face.

A reference herein to a patent document or other matter which is given as prior art is not to be taken as an admission that that document or matter was, in Australia, known or that the information it contains was part of the common general knowledge as at the priority date of any of the claims.

SUMMARY OF THE INVENTION

According to one aspect of this invention there is provided a reamer assembly for enlarging a substantially horizontal pilot bore hole in the ground to produce an enlarged bore hole, including a cutter which is rotatable about an axis having at least one cutter element at a radially peripheral portion of the cutter, a gear box positioned on a first side of the cutter, the gear box having a gearbox input for interacting with a drill rod which is rotated about the axis by a drive apparatus outside the pilot bore hole, the gear box also including a gearbox output which interacts at a radially central portion of the cutter, a body positioned on a second side of the cutter for transferring thrust from a thrust apparatus outside of the enlarged bore hole to the cutter, whereby the cutter rotates relative to the body.

The gearbox is preferably configured to increases the torque between the gearbox input and the gearbox output. The level of increase torque may take any suitable form, however it is preferred that the gearbox is configured to increase the torque by more than double between the gearbox input and the gearbox output.

The reamer assembly preferably includes a substantially cylindrical housing on the first side of the cutter which houses the gearbox, the cylindrical housing including pins for connection to a drill string, so that the cylindrical housing is prevented from rotating relative to the drill string. The cylindrical housing preferably includes a fluid supply port for connection to a fluid supply conduit in the drill string, with the cylindrical housing and the gear box defining a fluid path there between for fluid to travel over the gear box so as to cool the gear box. This arrangement of the cylindrical housing protects the gearbox from abrasion when being thrust through the borehole, while cooling the gearbox reduces the wear on the gears increasing the lifespan of the gearbox. It is preferred that at least one bearing is provided between the cylindrical housing and the gearbox output, so that the gearbox outlet can rotate smoothly relative to the cylindrical housing.

The cutter preferably includes a mount with a plurality of cutting elements that are each mounted thereto so as to each be spaced radially from the axis. The mount may take any suitable form and it is preferably configured to further define the fluid path as extending from the cylindrical housing through the mount, with the mount having at least one fluid outlet for spraying fluid towards at least one of the cutting elements. This arrangement helps cool the cutting elements while converting the spoil cut from the borehole to a slurry.

The mount preferably includes a plurality grading members each spacing an adjacent cutting element which combine with the cutting elements to grade the size of spoil passing to the body. It is further preferred that the grading members are each spaced from the body by a flange which guides the spoil as the cutter rotates.

The cylindrical housing is dimensioned so as to fit within the pilot hole, and in turn the gearbox is dimensioned to fit within the cylindrical housing. It therefore follows that a radial dimension from the axis to the cylindrical housing is less than a radial dimension from the axis to the radially peripheral portion of the cutter.

The body may take any suitable form and in one form it includes a cylindrical casing which is locatable in use in the bore hole, the casing having a spoil removal inlet adjacent the peripheral portion of the cutter for positioning in the bottom of the enlarged borehole. It is further preferred that the body includes an extraction port extending from the spoil removal inlet for connection to an extraction conduit associated with the thrust apparatus. Spoil will tend to want to move towards the lowest point in the borehole under the influence of gravity. This arrangement for removing spoil through the thrust apparatus, rather than the drill string, facilitates with the extraction of more spoil from the cutter.

The body preferably includes anti rotation means adapted for inhibiting rotation of the body within the bore hole. The anti-rotation means may take any form and in one form includes at least one anti rotation element that projects perpendicularly from said cylindrical casing.

A reamer assembly preferably includes at least one bearing between the cylindrical casing and the cutter. This arrangement provides for smooth rotation of the cutter relative to the cylindrical casing.

According to another aspect of this invention there is provided a microtunneling apparatus including a reamer assembly as herein before described and a drill string having the reamer assembly at a distal end of the drill string and external drive mechanism at a proximal end of the drill string, the drill string being formed by a plurality of connected string segments each string segment having a central axis with a drive shaft aligned along the central axis for rotation there about, an elongate casing that houses the drive shaft, the drive shaft being rotatably mounted within the casing, the drive shaft being hollow so that in use it allows fluid or gas to pass therethrough, a first cavity within the casing that extends longitudinally of the casing and offset from drive shaft wherein in use the external drive mechanism rotates the drive shaft so as to rotate the drilling head and fluid or gas is supplied trough the hollow drive shaft to the cutter.

Each string segment preferably includes a front end and a back end longitudinally displaced from the front end, wherein the front end of one string segment is adapted to connect with the back end of another string segment to form the drill string. A seal arrangement may be provided between the front end of said one string segment and the back end of said another string segment so that in use the shaft sealing arrangement impedes fluid in the drive shaft flowing to the first cavity between said front end and said back end of connected string segments. The seal arrangement may take any form and in one form it includes at least one gasket positioned between the drive shaft and the first cavity, on at least one of said front end or said back end of connected string segments. The seal arrangement may also include at least one gasket surrounding the drive shaft on at least one of said front end or said back end of connected string segments. The seal arrangement may also include at least one gasket surrounding the at least one cavity on at least one of said front end or said back end of connected string segment.

The front end of the string segment and the back end of said another string segment may be mutually adapted to form a snap connection there between which can be manually released. In one preferred configuration, the snap connection is adapted to be adjustable to allow for adjustment of an alignment of the front end of said one string segment with the back end of said another string segment. The snap connection may take any suitable form and in one preferred arrangement it includes a latch member biased towards an active position, the latch member associated with one of the front end of said one string segment or the back end of said another string segment, and a strike member associated with the other of the front end of said one string segment or the back end of said another string segment, the strike member interacts with the latch member so as to secure the front end of said one string segment with the back end of said another string segment when the latch member is in the active position. In one arrangement the strike member is an elongate member having leading portion that is conically shaped, however this may vary. In one preferred arrangement a detent arrangement adapted to interact with the latch member so as to retain the latch member either in the active position or an inactive position.

It is preferred that each drive shaft includes a male end and a female end each adapted so that the male end of the drive shaft can engage the female end of an adjacent drive shaft when the string segments are connected. The male end and the female end of the drive shaft may each have a complementary shape which provides a driving engagement therebetween for rotation in either a clockwise or anti-clockwise direction. One preferred complementary shape is a rounded triangle as it doesn't have corners it avoids concentrating stress at the corners, however other complementary shapes may be suitable.

It is preferred that the at least one cavity includes a second cavity within the casing that extends longitudinally of the casing and offset from drive shaft wherein in use the second cavity is adapted to for a laser beam to be directed therethrough. It is also preferred to include insulation between at least the second cavity and the drive shaft so as to reduce heat transfer between the drive shaft and the second cavity when in use. The preferred form of insulation is a hard or stiff foam material injected into the elongate casing to inhibit the ingress of water or swarf and enhance rigidity of the elongate casing, however other forms of insulation may also be suitable.

It is preferred that a channel be formed at the perimeter of the casing that extends longitudinally of the casing and offset from drive shaft wherein in use the channel is adapted to accommodate a control line, communication line or hydraulic tubing connecting the drive mechanism with the reamer. The channel may be an open channel or may be closed by a lid.

The elongate casing and at least the first cavity may be formed by any suitable process and in one preferred embodiment they are each roll formed or alternatively drawn.

According to further still another aspect of this invention there is provided a microtunneling apparatus including a reamer assembly as herein before defined and a drill string having the reamer assembly at a distal end of the drill string and external drive mechanism at a proximal end of the drill string, the drill string being formed by a plurality of connected string segments each string segment having a central axis with a drive shaft aligned along the central axis for rotation there about, an elongate casing that houses the drive shaft, the drive shaft being rotatably mounted within the casing, a first cavity within the casing that extends longitudinally of the casing and offset from drive shaft; each string segment includes a front end and a back end longitudinally displaced from the front end, wherein the front end of one string segment is adapted to connect with the back end of another string segment to form the drill string by way of a latch connection, the latch connection being adjustable so as to vary the tolerance between said front end of one string segment and said back end of another string segment while connected, wherein in use the external drive mechanism rotates the drive shaft so as to rotate the cutter. Providing an adjustable latch connection can assist in reducing pressure between adjacent sting segments that may be otherwise jamming the normal operation of the latch. It also provides the ability to compensate for the connection between the front end of the string segment and the back end of the string segment to wear due to use.

The latch connection can include a latch member that associated with one of the front end of said one string segment or the back end of said another string segment, the latch member is adjustable between an inactive position whereby said front end of one string segment is separable from said back end of another string segment, and an active position whereby said front end of one string segment is connected to said back end of another string segment. The latch connection preferably includes a detent member adapted to interact with the latch member so as to retain the latch member in the active position or the inactive position. The inclusion of a detent has been found useful when connecting and disconnecting adjacent string segments. A biasing member may also be included for biasing the latch member towards the active position. Where both a biasing member and a detent are included, it is preferred that the detent override the force of the biasing member so as to retain the latch member in the inactive position.

The drill string preferably includes an adjustment member that is adjustable to vary said tolerance between said front end of one string segment and said back end of another string segment while connected. The adjustment member may take any suitable form and in one preferred form the latch connection includes a strike member associated with either one of the front end of said one string segment or the back end of said another string segment, that interacts with said adjustment member to adjust a position of the strike member relative to the front end of said one string segment or the back end of said another string segment. It is further preferred that the strike member is an elongate member having leading portion that is conically shaped. Clearly the strike member may take another form however this arrangement facilitates locating the one end the of the string segment with said other end of an adjacent string segment.

The drill string preferably includes a seal arrangement between the front end of said one string segment and the back end of said another string segment so that in use the seal arrangement impedes the egress of swarf from the first cavity between said front end and said back end of connected string segments. The seal arrangement may take any suitable form and in one form the seal arrangement includes at least one gasket positioned between the drive shaft and the first cavity, on at least one of said front end or said back end of connected string segments. The seal arrangement may also include at least one gasket surrounding the drive shaft on at least one of said front end or said back end of connected string segments. The seal arrangement may also include at least one gasket surrounding the at least one cavity on at least one of said front end or said back end of connected string segment.

It will be convenient to hereinafter describe the invention in greater detail by reference to the attached illustrations of a preferred embodiment of the reamer assembly according to the invention. The particularity of those illustrations, and the accompanying detailed description is not to be understood as superseding the generality of the preceding definition of the invention according to each of its aspects.

BRIEF DESCRIPTION OF DRAWINGS

In order that the invention may be more fully understood, some embodiments will now be described with reference to the Figures in which.

DETAILED DESCRIPTION

Figure 1:
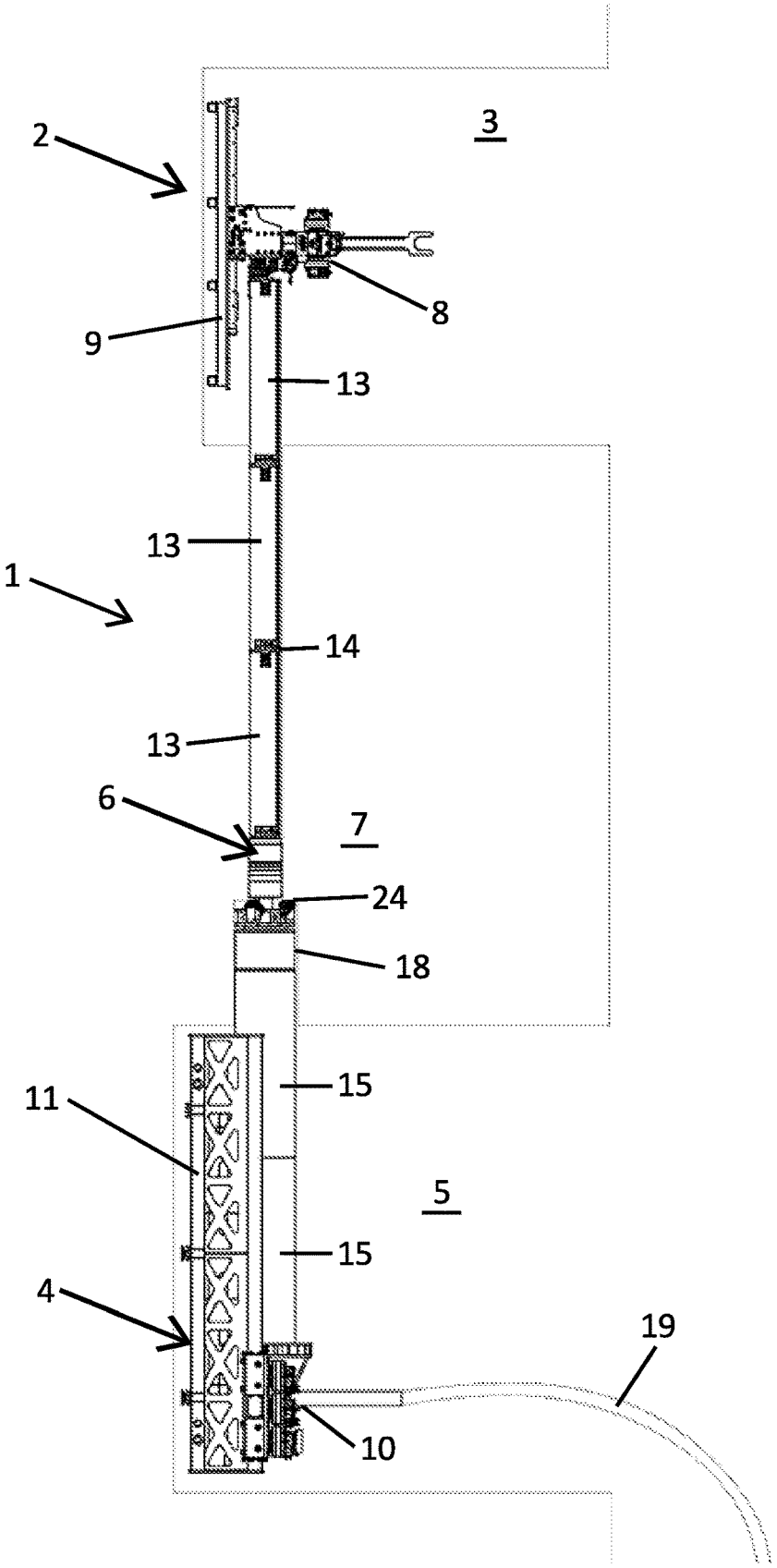
FIG. 1 is a side elevation view of an example of microtunneling apparatus including a preferred embodiment of a reamer assembly according to the invention.

Referring now to FIG. 1 which illustrates an example of a microtunneling apparatus 1 when in use. The microtunneling apparatus 2 includes in summary, drive apparatus 2 in a drive pit 3, thrust apparatus 4 in a thrust pit 5 which both interact with a reamer assembly 6 positioned therebetween in the ground 7. The drive apparatus 2 includes a driver 8 positioned on a drive platform 9 which is movable there along. Similarly, the thrust apparatus 4 is illustrated as including a thrust mechanism 10 positioned on a thrust platform 11 for movement there along.

Figure 2:
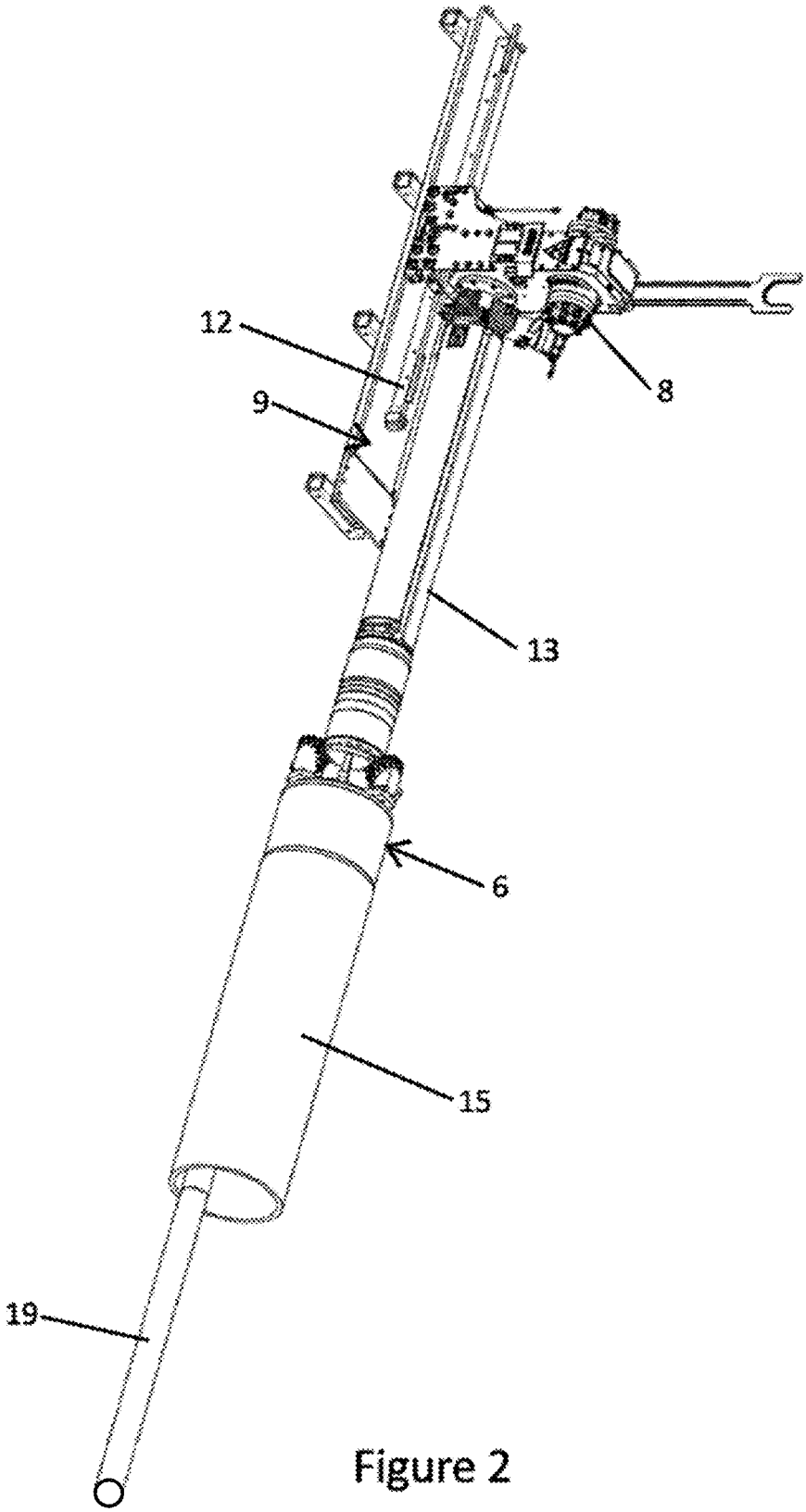
FIG. 2 is an isometric view of part of the microtunneling apparatus from FIG. 1 from a first perspective.

It can be appreciated from FIG. 2 that the drive platform 9 includes a guide rail 12 for linearly guiding movement of the driver 8 there along. The drive apparatus 2 also includes a drill string 32 which is releasably attached to a front of the driver 8. It can be appreciated from FIG. 1 that the drill string 32 includes a plurality of drill string segments 13 and is configured to be locatable within a pilot hole 14 in the ground, and FIG. 2 shows only one of those drill string segments 13. The pilot hole 14 will be previously formed by attaching a drill head (not shown) to the leading end of the drill string 32 in a manner that will be understood by those skilled in the art. While FIG. 1 illustrates the drill string 32 having three drill string segments 13, this number may vary depending upon the length of the pilot hole 14. The features of each drill string segment 13 will be described in greater detail with reference to later illustrations.

It ought to be appreciated from FIG. 1 that the length of the guide rail 12 on the drive platform 9 is longer than the drill string segments 13. This arrangement allows the driver 8 to be moved towards the rear of the drive pit 3 and permit disconnection of each drill string segment 13 from the front of the driver 8.

Figure 7:
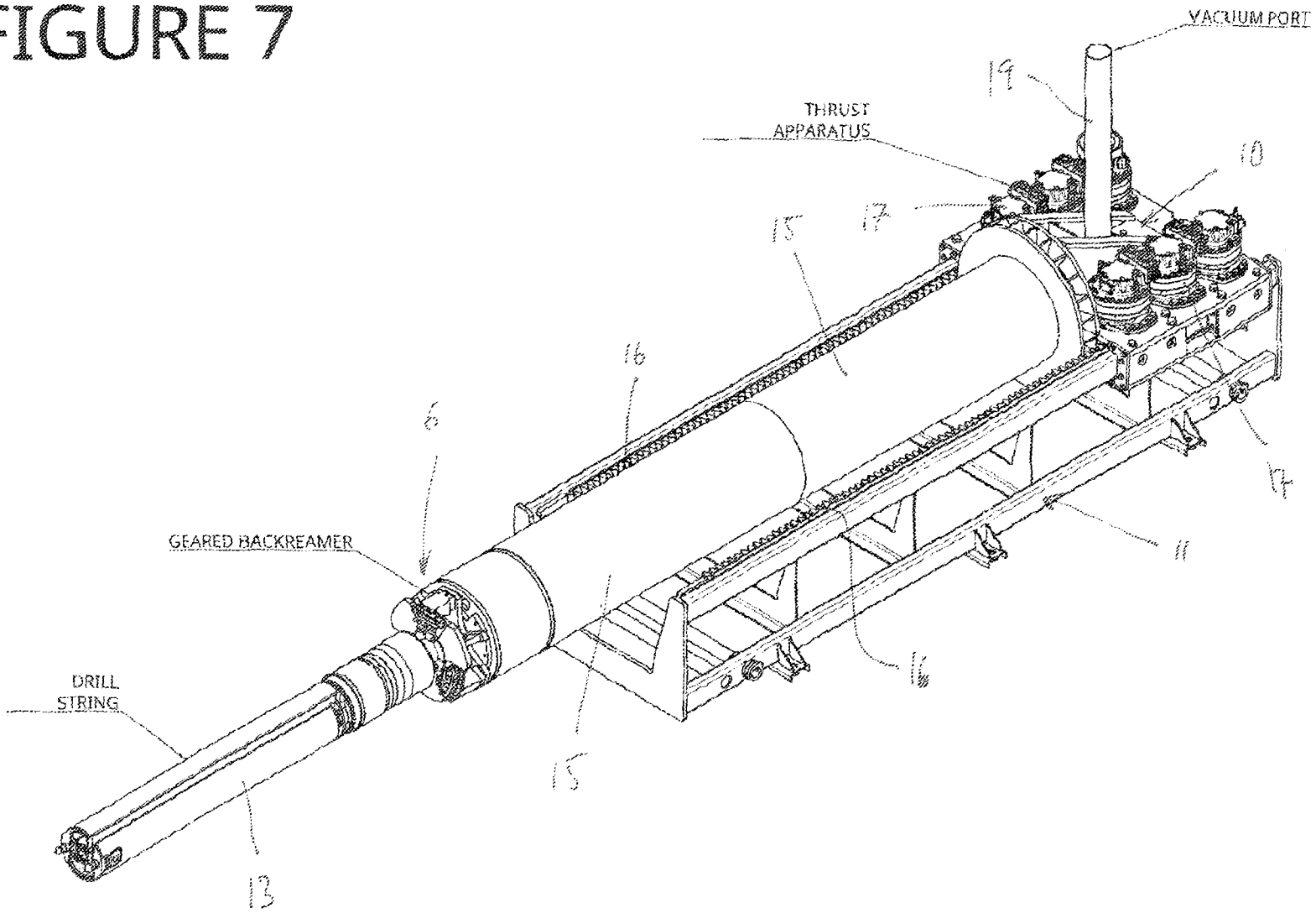
FIG. 7 is an isometric view of part of the microtunneling apparatus from FIG. 1 from a second perspective.

The thrust platform 11 in FIG. 1 is illustrated supporting two pipe segments 15, which are designed to transfer thrust from a thrust mechanism 10 to the reamer assembly 6. The thrust mechanism 10 is illustrated in FIG. 1 at the rear of the thrust platform 11. Referring briefly to FIG. 7 which illustrates the thrust platform 11 having a pair of racks 16, which are engaged by pinions (not shown) of motors 17 of the thrust mechanism 10. The operation of each motor 17 will cause rotation of each pinion to advance the thrust mechanism 10 along the tracks. Once the pipe segment 15 is fully inserted into the bore hole 18 (see FIG. 1), the thrust mechanism 10 can be reversed to the rear of the thrust platform 11 and a further pipe segment 15 dropped onto the thrust platform 11. Quite clearly the means for advancing the thrust mechanism 10 may vary from that as illustrated.

The thrust apparatus also supports part of a vacuum conduit (see FIG. 1, 2 or 7) through which spoil from the reamer assembly 6 passes, to be dispensed outside of the thrust pit 5.

Referring now to FIGS. 3, 4, 5 and 6 collectively which illustrate a preferred embodiment of the reamer assembly 6 according to the invention. The reamer assembly 6 in summary includes a gear box 20 positioned on a first side of a cutter 21, and a body 22 positioned on the second side of the cutter 21. The cutter 21 is rotatable about an axis X-X, while the body 22 is thrust in the direction of the axis X-X to as to engage a working face 24 between the bore hole 18 and the pilot hole 14 (see FIG. 1).

Figure 4:
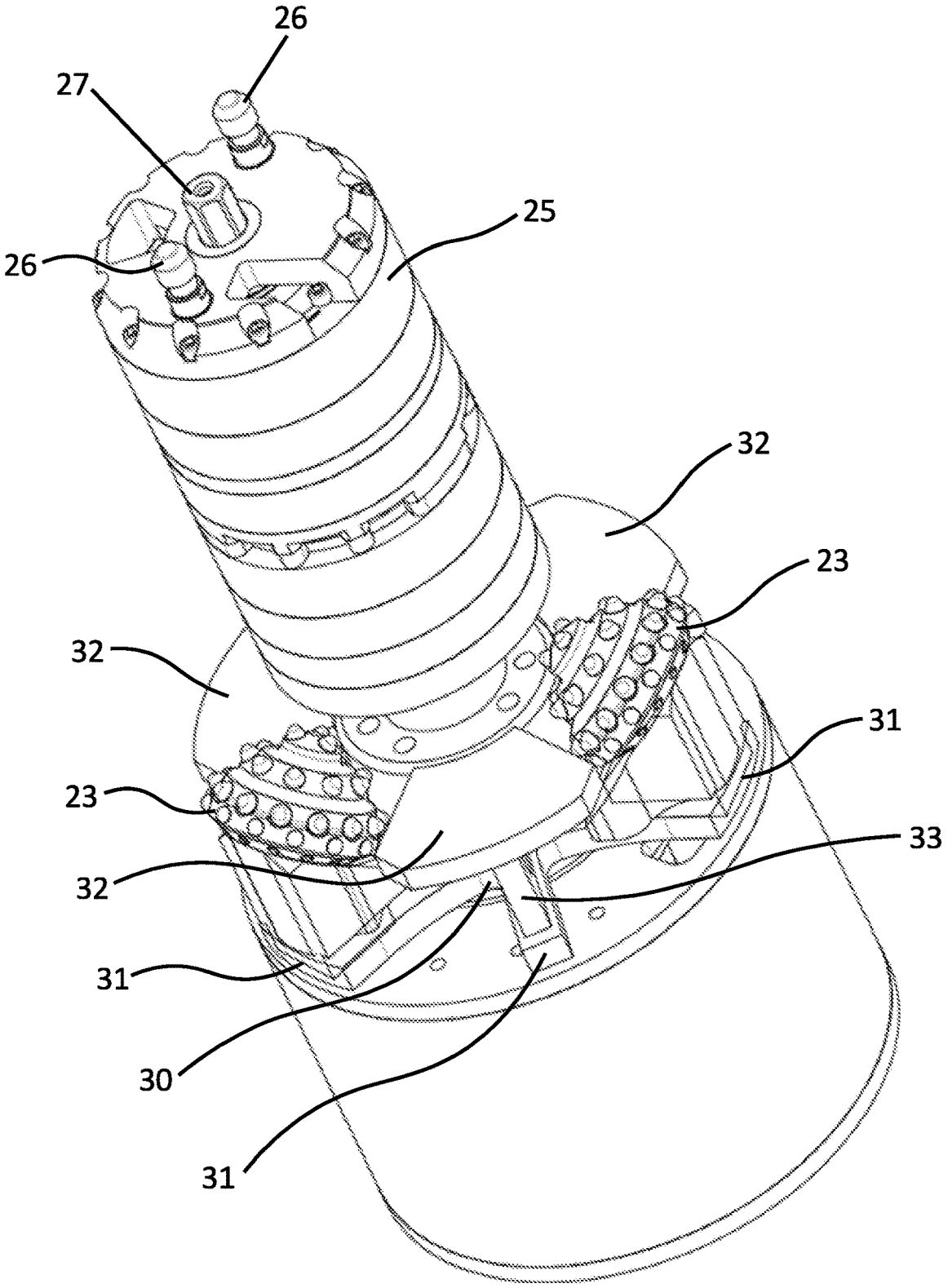
FIG. 4 is an isometric view from a first perspective of the reamer assembly from FIG. 1.
Figure 5:
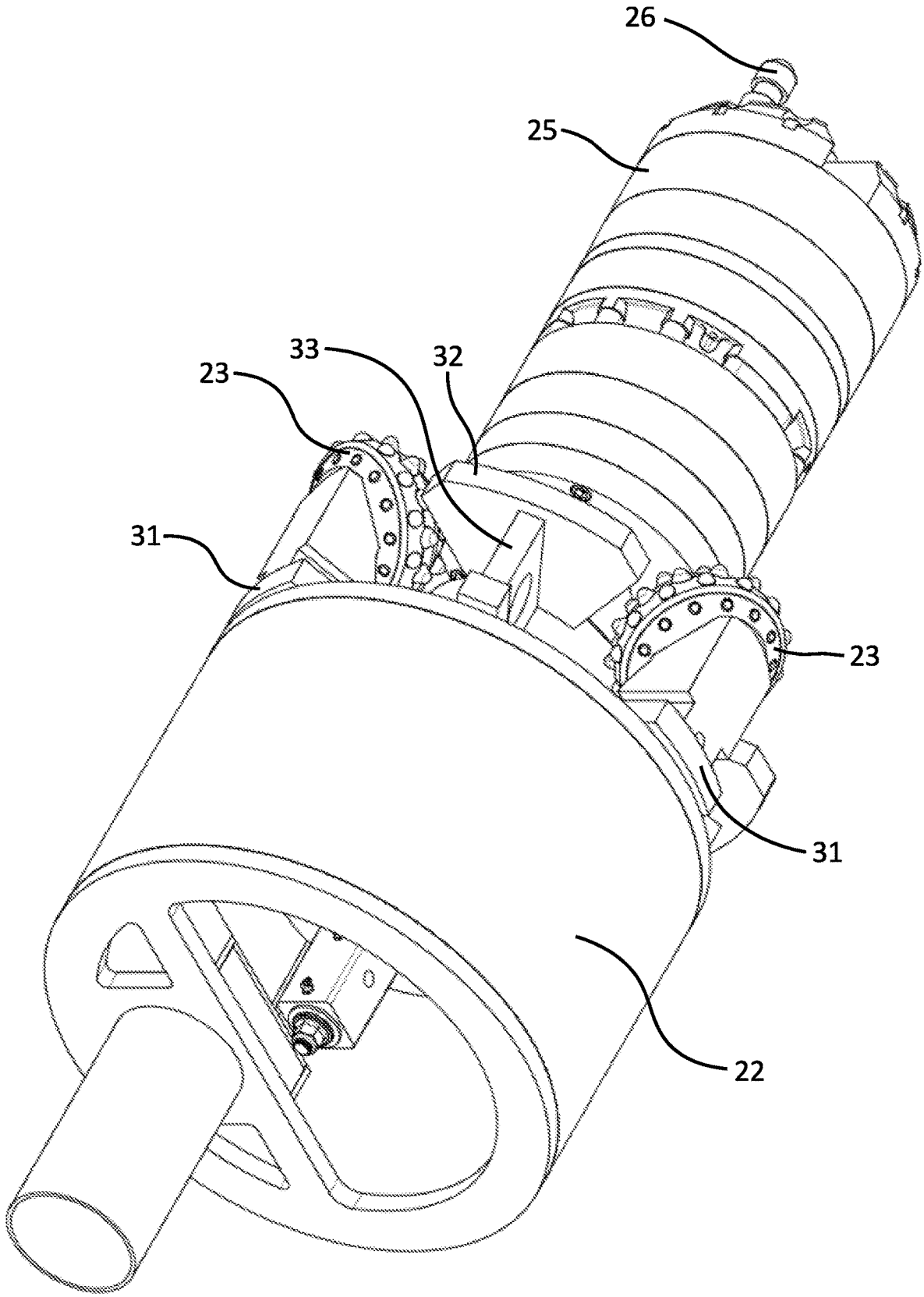
FIG. 5 is an isometric view from a second perspective of the reamer assembly from FIG. 1.
Figure 6:
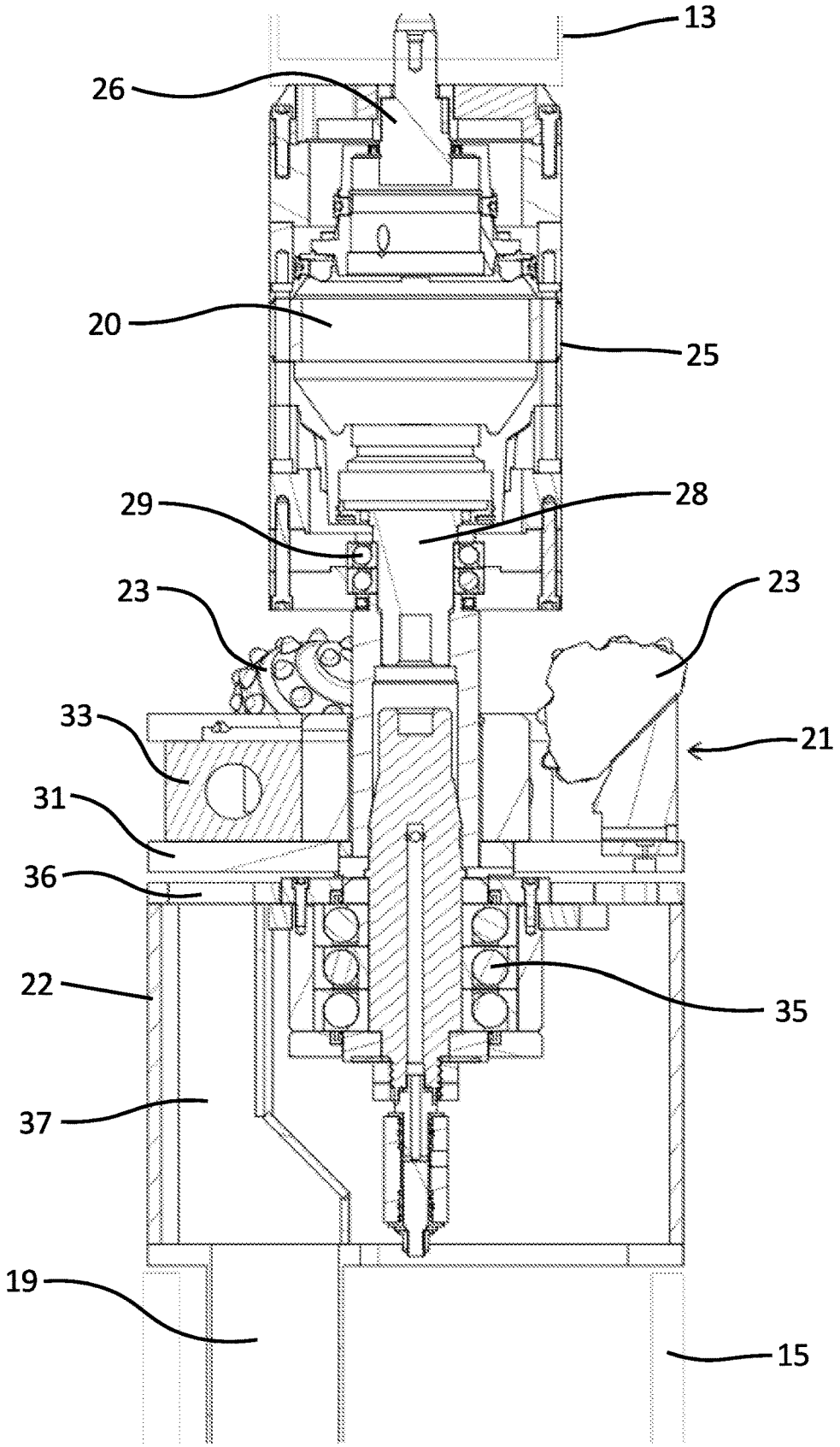
FIG. 6 is a further long sectional view of the reamer assembly when connected to the drill string and pipe section.

The gearbox 20 is located within a cylindrical housing 25 which protects the gearbox 20 while it moves through the pilot hole 14. The cylindrical housing 25 has a pair of pins 26 which facilitate attachment of the cylindrical housing 25 to the drill string segment 13, so that the cylindrical housing 25 is prevented from rotating relative to the drill string 32. A gearbox input 27 is shown in FIG. 4 protruding from the cylindrical housing 25 for connection to a drill rod (not shown) within the drill string 13. The drill rod is rotated by the driver 8 (see FIG. 1) so as to rotate the gearbox input 27. The gearbox 20 is preferably configured to increase torque between the gearbox input 27 and the gearbox output 28. The preferred increase is more than double, with a 4:1 ratio most preferred, however other ratios may be more suitable depending upon the conditions on which the reamer assembly is operating. In such cases the cylindrical housing 25 can be opened and a gearbox 20 with a more suitable ratio installed.

Figure 3:
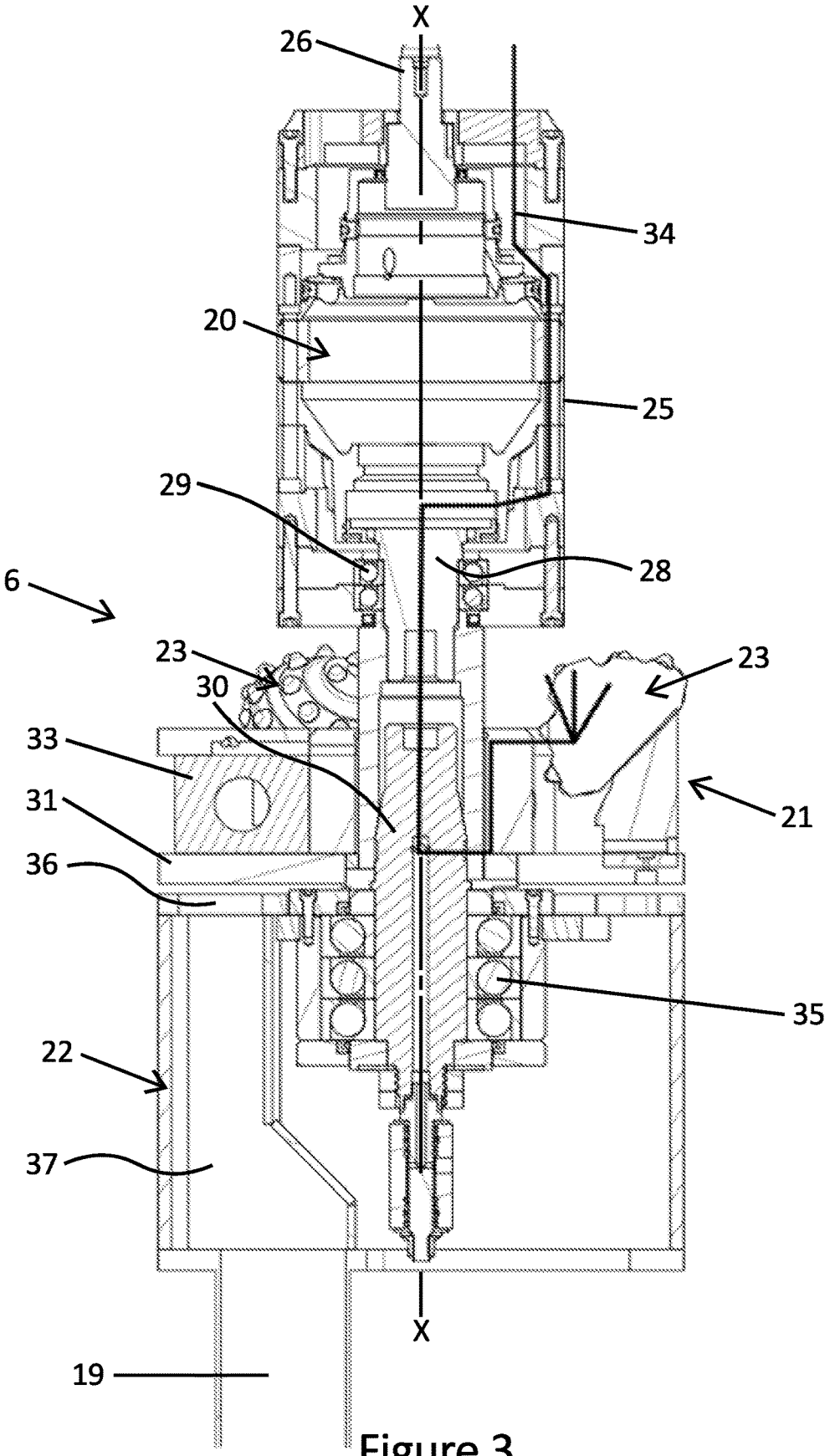
FIG. 3 is a long sectional view of a preferred embodiment of the reamer assembly from FIG. 1.

FIG. 3 also illustrates a pair of bearings 29 positioned between the gearbox output 28 and the cylindrical housing 25. The pair of bearings 29 is provided to facilitate a smooth rotation of the gearbox output 28 relative to the cylindrical housing 25. The number and position of the bearings 29 may vary from that as illustrated in FIG. 3.

Referring still to FIG. 3, it can be noted that the gearbox output 28 is attached to the cutter 21. More specifically the cutter 21 includes a mount 30, and the gearbox output 28 is attached to a central portion of that mount 30. The preferred mount 30 is further illustrated in FIG. 4 as having a plurality of radially extending arms 31. The cutter 21 includes three cutting elements 23 (only two are visible in the illustrations) which are releasably attached to each alternate arm. FIG. 4 also illustrates each cutter element 23 being spaced by a grading plate 32 positioned remote from its respective arm 31 of the mount 30 by a flange 33. The function of the grading plate 32 is to provide limited space either side thereof for spoil to pass between the cutting element 23 and the grading plate 32 to, in effect, create a sieve sizing of the spoil before it is extracted from the reamer assembly 6.

FIG. 3 illustrates a fluid path 34 in the reamer assembly whereby fluid is conveyed from the drill string 32 to the cutting elements 23. The cylindrical housing 25 with the gearbox 20 is configured to define in part the fluid path 34 in such a way that fluid passing over the gearbox 20 cools the gearbox 20. The cooling of the gearbox 20 has the advantage of reducing the deterioration of the gears (not shown) therein as caused when gearboxes are overheated. The fluid path 34 extends through the mount 30 and is sprayed onto the cutting elements 23 which facilitates the operation of the cutting elements 23 at the working face 24 of the bore hole 18. The fluid combines with the spoil to create a slurry which facilitates extraction from the cutter 21 via the vacuum conduit 19.

FIG. 3 also illustrates the cutter 21 being attached to the body 22 at the rear of the cutter 21. Three bearings 35 are positioned between the cutter 21 and the body 22 so as to facilitate smooth rotation of the cutter 21 relative to the body 22. It can be appreciated from FIG. 4 that the body 22 is preferably a cylindrical casing having the same diameter to that of the pipe segments 15. The body 22 transfers the thrust from the pipe 15 through the bearings 35 to the mount 30. The cylindrical casing 22 has a spoil removal inlet 36 adjacent a peripheral portion of the mount arms 31, which in use is positioned at the bottom of the bore hole 18. The body 22 includes an extraction port 37 within the casing which connects the extraction inlet 36 to the vacuum conduit 19 for extracting the spoil from the bore hole 18.

The manner in which the microtunneling apparatus 1 operates will now be explained with reference to illustrations in general. The microtunneling apparatus 1 will generally be installed onsite once the drive pit 3, pilot hole 14 and thrust pit 5 have been formed. The drill string 32 will occupy the entire length of the pilot hole 14 with the drilling head (not shown) removed and replaced by the reamer assembly 6. With the reamer assembly 6 in place the driver 8 can cause the drill rod (not shown) to rotate about the axis X-X causing the cutter 21 to rotate relative the working face 24 of the bore hole 18. Thrust is applied to the body 22 by the thrust apparatus 4 so as to urge the reamer assembly 6 to engage the work face 24. The thrust apparatus 4 thrusts the pipe segments 15 into the bore hole 18, and at the same time drill string segments 13 are extracted from the drive pit 3 once they are forced out of the pilot hole 14 through the operation. Fluid is supplied through the drive pit 3 along the drill string 13 to the cutter 21, whilst spoil is extracted from the bore hole 18 through the vacuum conduit 19 and out of the thrust pit 5.

Figure 8:
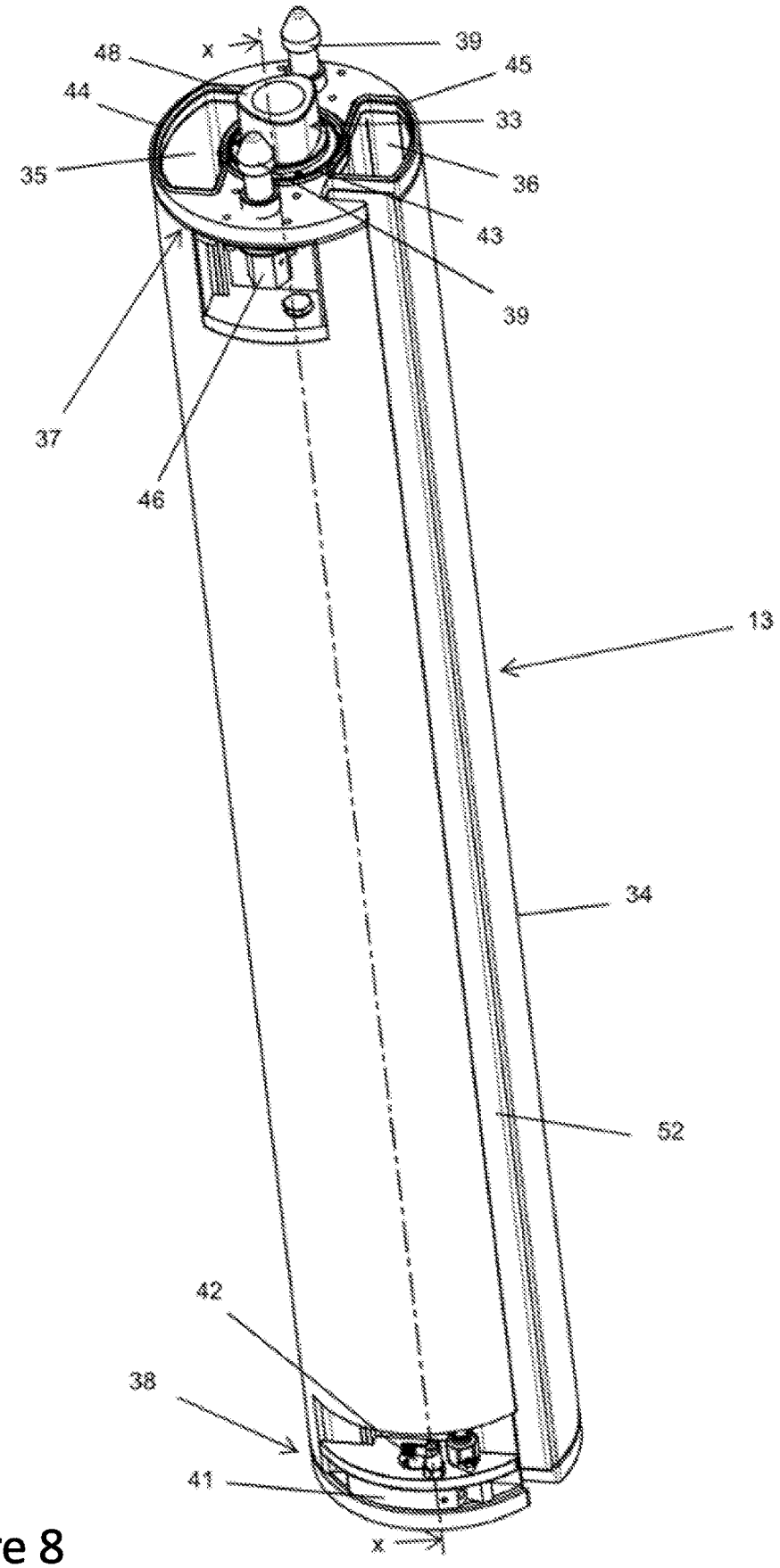
FIG. 8 is an isometric view of a preferred embodiment of a drill string segment from a backend perspective.

Referring now to FIG. 8 which illustrates a preferred embodiment of a drill string segment 13 having a drive shaft 33 arranged for rotation about a central axis X-X, for attachment to the gearbox 20 (see figure). It can be noted that the drive shaft is hollow along the central axis X-X, so as to allow fluid or gas to transfer therethrough from the drive apparatus 2 (see FIG. 1) to the cutter 21, however this is not essential. The drill string segment 13 also includes an elongate casing 34 that houses the drive shaft 33, along with a first cavity 35 and a second cavity 36. The first cavity 35 can be used to remove swarf and fluid that isn't removed from work face 24 (see FIG. 1) the through the vacuum conduit 19. While the second cavity 36 can be used for sighting a laser beam therethrough to facilitate guiding the drilling head.

In an alternate embodiment not shown, the drive shaft 33 may be solid and gas may be supplied through the second cavity 36 to the cutter 21. In this alternate arrangement the gas supplied not only assists in forcing the swarf out through the first cavity 35, but also assists in cooling the space in which the laser beam is operating. It has been appreciated that the drill string segments 13 heat up when in use, and the more the space in the second cavity 36 heats up the greater the distortion in laser beam. Accordingly, by keeping the space cool this reduces the distortion in the laser beam.

FIG. 8 illustrates a back end 37 and a front end 38 of the drill string segment 13. The use of front and back as used herein is merely to assist in the explanation rather than impose any limitation on the features. The back end 37 includes a pair of strikes 39 in the form of a pair of elongate members 39 which are adapted to locate in within apertures 40 formed in the front end 38. A pair of latch members 41 (only one visible in FIG. 8) engages with the elongate members 39 to create a connection between the front end 38 of one drill string segment 13 and a back end 37 of an adjacent drill string segment 13 (see FIG. 1 for example of adjacent segments 13).

Figure 10:
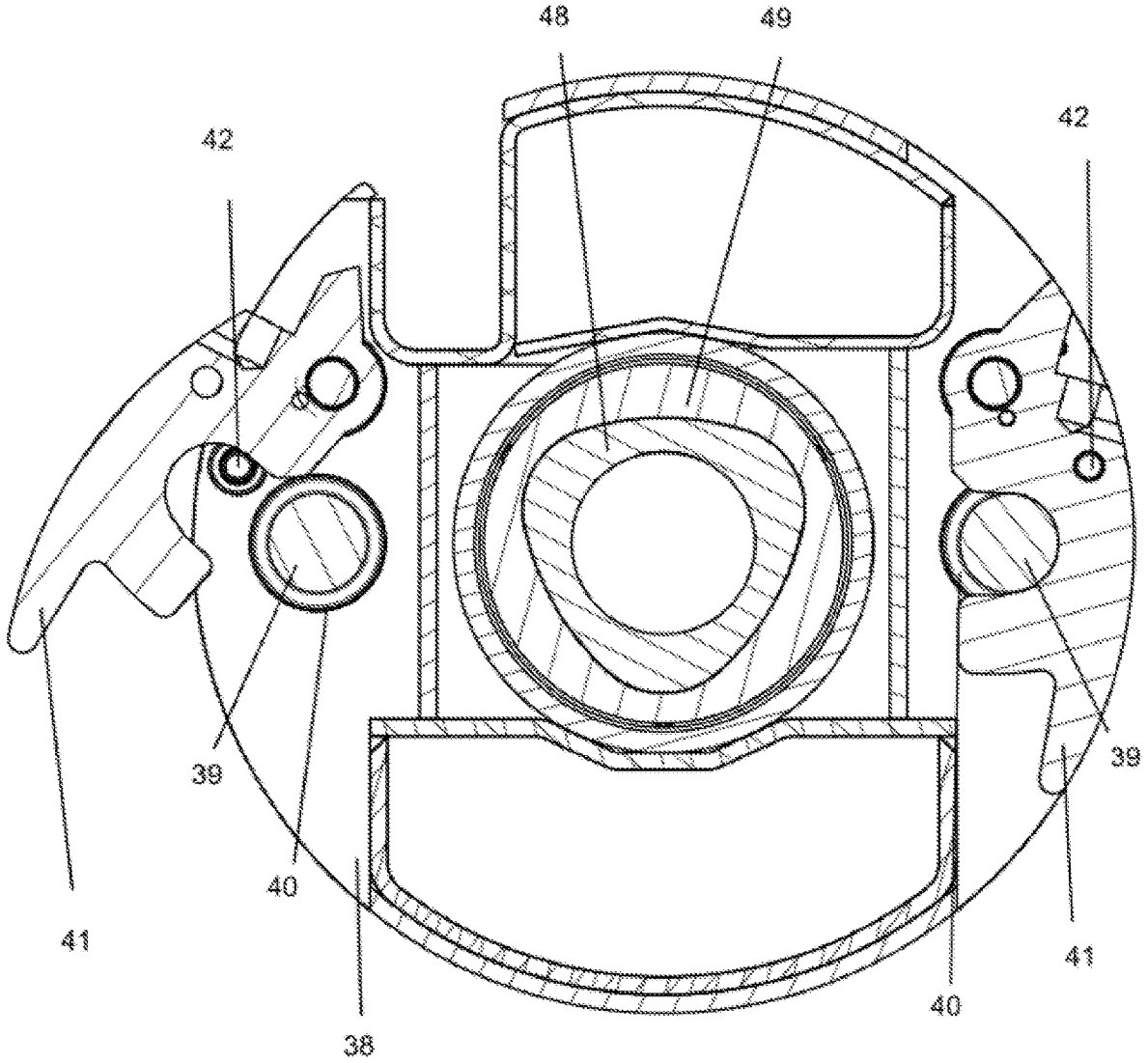
FIG. 10 is a cross sectional view through adjacent drill string segments.

FIG. 10 shows the front end 39 with the pair of latch members 41, with the latch member 41 on the left hand side in an open condition and the latch member 41 on the right hand side in a closed condition. The latch members 41 may be biased towards a closed condition, so that the elongate members 39 can engage the latch members 41 in a snap connection. However, detents 42 can also be included to retain the latch members 41 in either the open or closed condition, thereby requiring manual adjustment of detents 42 and the latch members 41 before the latch members 41 can adopt the closed condition.

Figure 9:
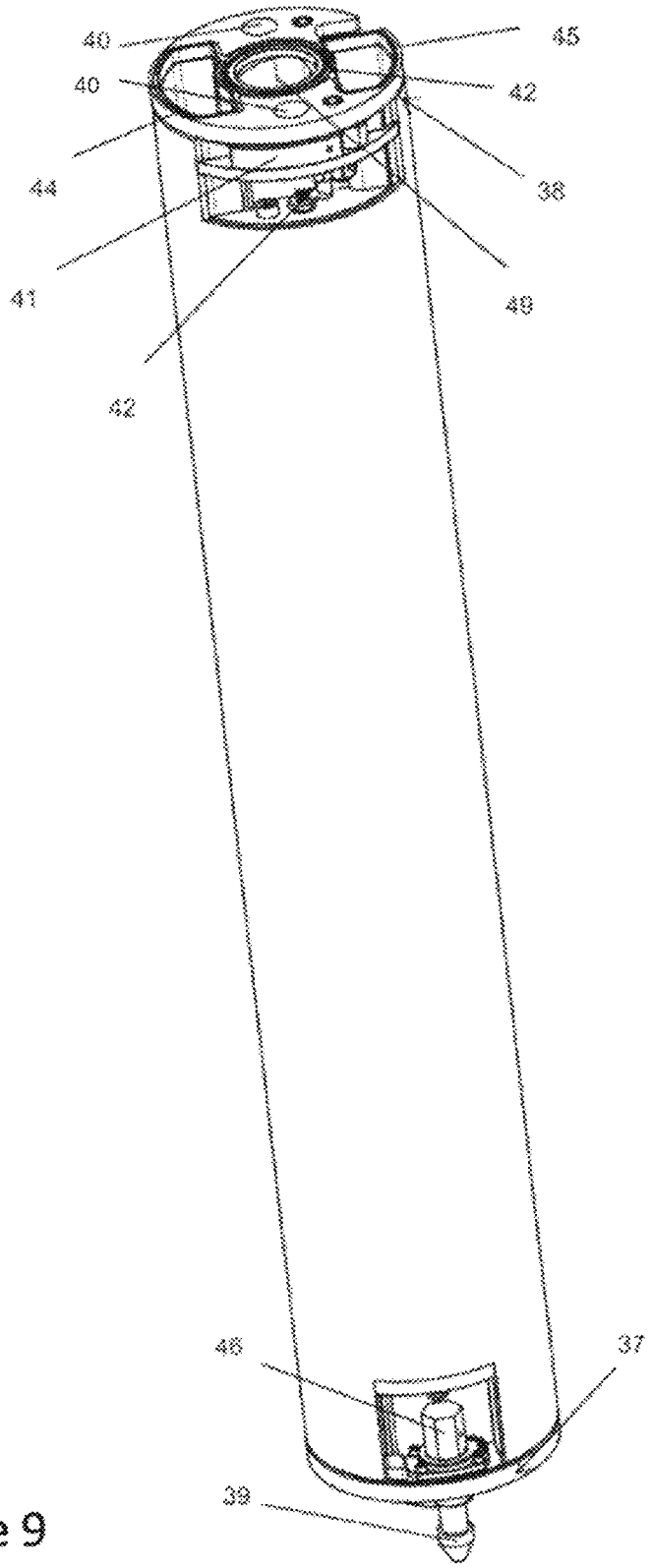
FIG. 9 is an isometric view of a preferred embodiment of the drill string segments from FIG. 8 from a front end perspective.

Referring again now to FIGS. 8 and 9 which show the back end 37 and front end 38 respectively which show a drive shaft gasket 43, surrounding the drive shaft 33, a first cavity gasket 44 surrounding an opening to the first cavity 35 and a second cavity gasket 45 surrounding an opening to the second cavity 36. FIGS. 8 and 9 also show an adjuster 46 to the rear of the elongate member 39 that is rotatable to adjust the length of the elongate member 39. While it is generally desirable that the front end 38 of one drill string segment 13 is to be parallel with the back end 37 of an adjacent drill string segments 13, the adjustor 46 allows for minor adjustment in tolerance. This can be useful in permitting adjustment of the angle of one drill string segment 13 with an adjacent drill string segment 13. The adjustor 46 can also be beneficial for reducing pressure on the latch members 41 that may have become stuck in the closed position after use. Further the adjustor 46 can also increase tension in the connection that may have become lose over time, extending the working like of the drill string 32.

FIG. 8 shows a male end 48 of the drive shaft 33 which is complementary shaped to fit within a female end 49 (see FIG. 9) of the drive shaft 33 of an adjacent drill string segment 33. It can be most appreciated from FIG. 10 that the complementary shape is a rounded triangle. This shape has been found to be an improvement over say a hexagonal shape as it avoids concentrating stresses at the corners of the hexagon, and is easier to disconnect adjacent drive shafts 33.

Figure 11:
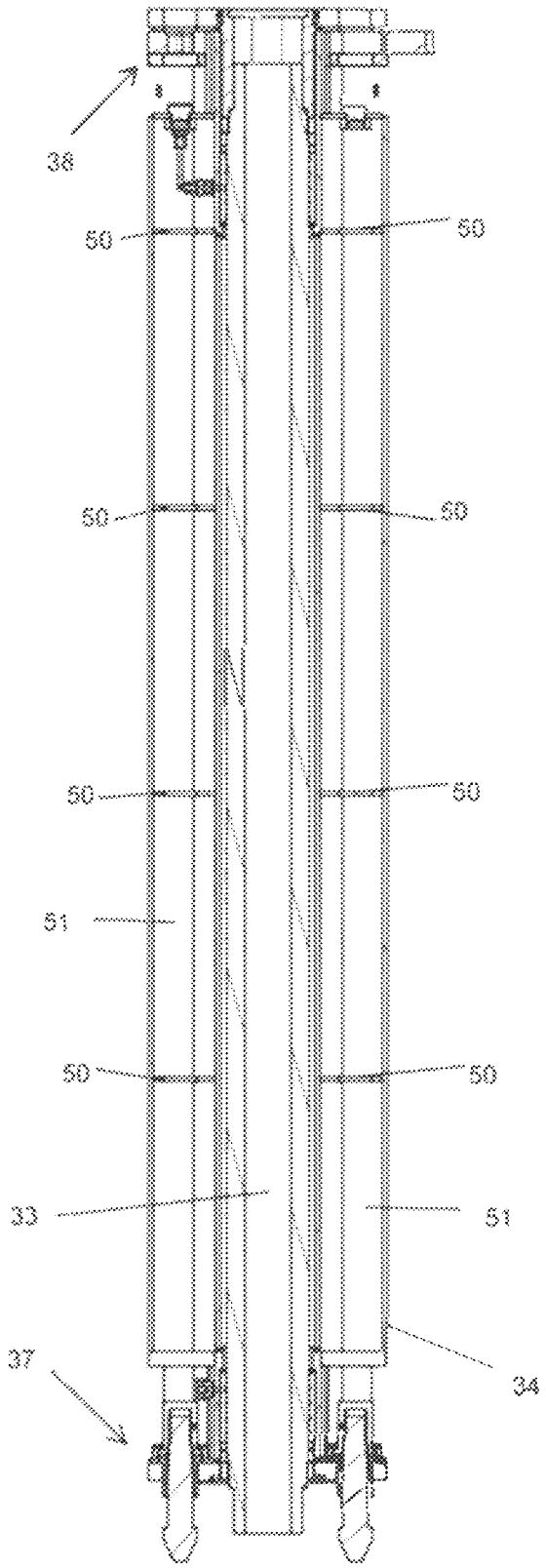
FIG. 11 is a long sectional view through a drill string segment.

FIG. 11 illustrates the drill string segment 13 in long section to show the elongate casing 34 is supported by a plurality of spaced ribs 50. An insulating foam 51 can be located between the elongate casing and the ribs to insulate heat from the drive shaft 33 from at least the second cavity 36 (see FIG. 8). The insulating foam is preferably relatively hard/stiff so as to provide a structural rigidity to the drill string segment 13.

Referring again to FIG. 8 which illustrates the elongate casing 33 being formed with a channel 52 that can accommodate communications tubing, hydraulic lines, or the like for communicating/interacting with the cutter 21. Whilst the figures show an open channel 52, it may be a closed longitudinal cavity similar to the first cavity 35 and second cavity 36, or it might be enclosed by a movable lid. The addition of a movable lid can provide additional protection to the tubing and lines.

The elongate casing 34, first cavity 35 and second cavity 36 may be formed in any suitable manner and one preferred arrangement is to form these features by roll forming or drawn.

It ought to be appreciated from the foregoing that the reamer assembly 6 as hereinbefore described provides a relatively simple means for increasing torque to the cutter 21 at the work face 24 of the bore hole 18. Utilising water supply that is likely to have already been provided to the drive apparatus 2 when producing the pilot hole 14 to cool the gearbox 20 provides a further useful result. Still furthermore, extracting the spoil at the spoil removal inlet 36 which is adjacent to the peripheral portion of the cutter 21 and out through the pipe segments 15, rather than through the drill string 13 provides for more efficient extraction of the spoil.

Various alterations and/or additions may be introduced into the reamer assembly as hereinbefore described without departing from the spirit or ambit of the invention.

What is claimed is:

1. A reamer assembly for enlarging a substantially horizontal pilot hole in the ground to produce a bore hole, including a cutter which is rotatable about an axis having at least one cutter element at a radially peripheral portion of the cutter, a gearbox positioned on a first side of the cutter, the gearbox having a gearbox input for interacting with a drill rod which is rotated about the axis by a drive apparatus outside the pilot bore hole, the gearbox also including a gearbox output which interacts with a radially central portion of the cutter, a body positioned on a second side of the cutter for transferring thrust from outside of the enlarged bore hole to the cutter, whereby the cutter rotates relative to the body.

2. A reamer assembly according to claim 1 wherein the gearbox is configured to increases torque between the gearbox input and the gearbox output.

3. A reamer assembly according to claim 2, wherein the gearbox is configured to increase the torque by more than double between the gearbox input and the gearbox output.

4. A reamer assembly according to claim 3 including a substantially cylindrical housing on the first side of the cutter which houses the gearbox, the cylindrical housing including pins for connection to a drill string, so that the cylindrical housing is prevented from rotating relative to the drill string.

5. A reamer assembly according to claim 4 wherein the cylindrical housing includes a fluid supply port for connection to a fluid supply conduit in the drill string, with the cylindrical housing and the gearbox defining a fluid path therebetween for fluid to travel over the gearbox so as to cool the gearbox.

6. A reamer assembly according to claim 4 wherein the cutter includes a mount with a plurality of cutting elements that are each mounted thereto so as to each be spaced radially from the axis.

7. A reamer assembly according to claim 6 wherein the mount is configured to further define a fluid path as extending from the cylindrical housing through the mount, the mount having at least one fluid outlet for spraying fluid towards at least one of the cutting elements.

8. A reamer assembly according to claim 7 wherein the mount includes a plurality of grading members each spacing an adjacent cutting element from an another cutting element, and that combine with the cutting elements to grade a size of spoil passing to the body.

9. A reamer assembly according to claim 8 wherein the grading members are each spaced from the body by a flange which guides the spoil as the cutter rotates.

10. A reamer assembly according to claim 4 wherein a radial dimension from the axis to the cylindrical housing is less than a radial dimension from the axis to the radially peripheral portion of the cutter.

11. A reamer assembly according to claim 1 wherein the body includes a cylindrical casing which is locatable in use in the bore hole, the casing having a spoil removal inlet adjacent the peripheral portion of the cutter for positioning in a bottom of the bore hole.

12. A reamer assembly according to claim 11 wherein the body includes an extraction port extending from the spoil removal inlet for connection to an extraction conduit.

13. A microtunneling apparatus including a reamer assembly according to claim 1 and a drill string having the reamer assembly at a distal end of the drill string and external drive mechanism at a proximal end of the drill string, the drill string being formed by a plurality of connected string segments each string segment having a central axis with a drive shaft aligned along the central axis for rotation there about, an elongate casing that houses the drive shaft, the drive shaft being rotatably mounted within the casing, the drive shaft being hollow so that in use the drive shaft allows fluid or gas to pass therethrough, a first cavity within the casing that extends longitudinally of the casing and offset from drive shaft wherein in use the external drive mechanism rotates the drive shaft so as to rotate a drilling head and fluid or gas is supplied trough the hollow drive shaft to the cutter.

14. A microtunneling apparatus according to claim 13 wherein each string segment includes a front end and a back end longitudinally displaced from the front end, wherein the front end of one string segment is adapted to connect with the back end of another string segment to form the drill string.

15. A microtunneling apparatus according to claim 14 wherein the front end of the string segment and the back end of said another string segment are mutually adapted to form a snap connection therebetween that is manually releasable.

16. A microtunneling apparatus according to claim 15 wherein the snap connection is adapted to be adjustable to allow for adjustment of an alignment of the front end of said one string segment with the back end of said another string segment.

17. A microtunneling apparatus according to claim 16 wherein the snap connection includes a latch member biased towards an active position, the latch member associated with one of the front end of said one string segment or the back end of said another string segment, and a strike member associated with the other of the front end of said one string segment or the back end of said another string segment, the strike member interacts with the latch member so as to secure the front end of said one string segment with the back end of said another string segment when the latch member is in the active position.

* * * * *